US009670699B2

(12) United States Patent
Sallinen et al.

(10) Patent No.: US 9,670,699 B2
(45) Date of Patent: Jun. 6, 2017

(54) PADLOCK

(71) Applicant: ABLOY OY, Joensuu (FI)

(72) Inventors: Tomi Sallinen, Joensuu (FI); Veli-Pekka Kyllonen, Kontioniemi (FI)

(73) Assignee: Abloy OY, Joensuu (FI)

( * ) Notice: Subject to any disclaimer, the term of this patent is extended or adjusted under 35 U.S.C. 154(b) by 0 days.

(21) Appl. No.: 14/354,089

(22) PCT Filed: Oct. 26, 2012

(86) PCT No.: PCT/FI2012/051034

§ 371 (c)(1),
(2) Date: Apr. 24, 2014

(87) PCT Pub. No.: WO2013/060942

PCT Pub. Date: May 2, 2013

(65) Prior Publication Data

US 2014/0311195 A1 Oct. 23, 2014

(30) Foreign Application Priority Data

Oct. 28, 2011 (FI) ..... 20116058

(51) Int. Cl.

| | |
|---|---|
| ***E05B 67/24*** | (2006.01) |
| ***E05B 67/18*** | (2006.01) |
| ***E05B 17/00*** | (2006.01) |
| ***E05B 17/14*** | (2006.01) |
| *E05B 67/02* | (2006.01) |
| *E05B 67/10* | (2006.01) |

(52) U.S. Cl.

CPC ..... *E05B 67/18* (2013.01); *E05B 17/002* (2013.01); *E05B 17/142* (2013.01); *E05B 67/24* (2013.01); *E05B 67/02* (2013.01); *E05B 67/10* (2013.01); *Y10T 70/459* (2015.04); *Y10T 70/491* (2015.04)

(58) Field of Classification Search

CPC ... Y10T 70/489; Y10T 70/491; Y10T 70/459; Y10T 70/415; Y10T 70/424; Y10T 70/498; Y10T 70/446; F16B 35/06; E05B 67/24; E05B 67/22; E05B 67/10; E05B 67/383; E05B 67/003; E05B 67/02; E05B 9/084

USPC ..... 70/50–56, 38 A, 35, 455, 423, 424, 70/367–371; 285/901, 148, 23; 138/89, 138/96 T; 411/383, 397, 349, 549, 553; 222/544

See application file for complete search history.

(56) References Cited

U.S. PATENT DOCUMENTS 1,369,506 A * 2/1921 Voight ..... 70/455
1,618,997 A * 3/1927 Radandt ..... 70/260
(Continued)

FOREIGN PATENT DOCUMENTS

CN 2130889 Y 4/1993
CN 201212309 Y 3/2009
(Continued)

*Primary Examiner* — David E Sosnowski
*Assistant Examiner* — Morgan McClure
(74) *Attorney, Agent, or Firm* — Muncy, Geissler, Olds & Lowe, P.C.

(57) ABSTRACT

A padlock, which is capable of remaining functional in even very dusty, watery or otherwise difficult conditions is disclosed. In addition, there would be reason for forming the protection level of the padlock to be selectable and updatable as needed to be even better. A protective cap is provided with a gasket and possibly gasketed latch elements.

3 Claims, 3 Drawing Sheets

(56) References Cited

U.S. PATENT DOCUMENTS

Figure 1:
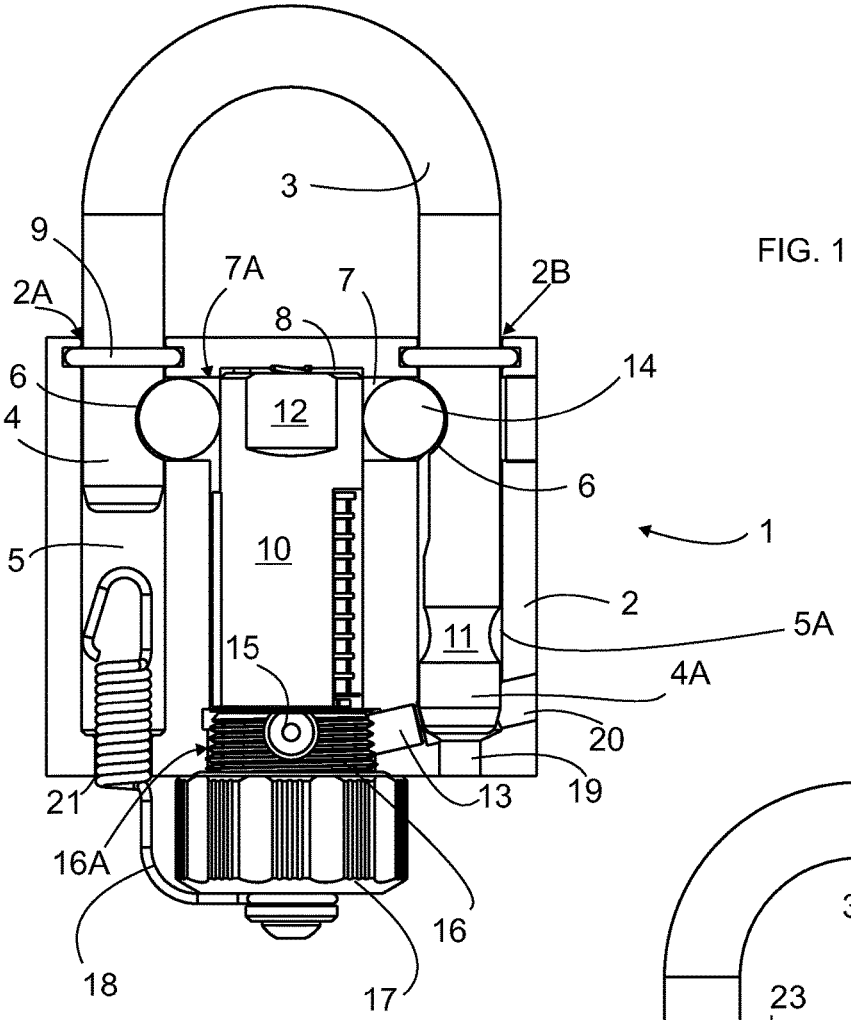

| | | | | | |
|---|---|---|---|---|---|
| 1,634,655 | A * | 7/1927 | Elstone | 220/304 |
| 1,702,878 | A * | 2/1929 | Mersfelder et al. | 220/287 |
| 2,487,642 | A * | 11/1949 | De Waltoff | 222/320 |
| 2,571,641 | A * | 10/1951 | Wing | 411/141 |
| 2,904,985 | A * | 9/1959 | Murphy | 70/51 |
| 3,220,078 | A * | 11/1965 | Preziosi | 411/349 |
| 3,424,481 | A * | 1/1969 | Fulghum | 285/140.1 |
| 3,852,836 | A * | 12/1974 | Oberholtzer | 4/219 |
| 3,855,824 | A * | 12/1974 | Falk | 70/38 A |
| 3,858,419 | A * | 1/1975 | Hampton | 70/55 |
| 3,934,437 | A * | 1/1976 | Crepinsek | 70/370 |
| 3,961,508 | A * | 6/1976 | Crepinsek | 70/370 |
| 4,218,902 | A * | 8/1980 | Druschel | 70/55 |
| 4,226,100 | A * | 10/1980 | Hampton et al. | 70/51 |
| 4,290,279 | A * | 9/1981 | Fish et al. | 70/38 A |
| 4,293,984 | A * | 10/1981 | Kaufmann, Jr. | 411/553 |
| 4,307,763 | A * | 12/1981 | Wang | 141/364 |
| 4,317,344 | A * | 3/1982 | Barnard | 70/55 |
| 4,428,211 | A * | 1/1984 | Hermann | 70/34 |
| 4,545,223 | A * | 10/1985 | Poutiainen et al. | 70/38 A |
| 4,776,187 | A * | 10/1988 | Evans et al. | 70/38 A |
| 4,836,001 | A * | 6/1989 | Foshee | 70/368 |
| 5,201,202 | A * | 4/1993 | Kam | 70/168 |
| 5,209,257 | A * | 5/1993 | Baker, Jr. | 137/315.04 |
| 5,241,846 | A * | 9/1993 | Hoke | 70/455 |
| 5,394,711 | A * | 3/1995 | Pitkanen | 70/38 A |
| 5,761,935 | A * | 6/1998 | Adelmeyer | 70/55 |
| D408,262 | S * | 4/1999 | Liu | D8/334 |
| 5,979,200 | A * | 11/1999 | Cliff | 70/491 |
| 6,272,890 | B1 * | 8/2001 | Huston | 70/423 |
| 6,360,908 | B1 * | 3/2002 | Kline | 220/257.1 |
| 6,467,316 | B1 * | 10/2002 | Chen | 70/56 |
| 6,470,612 | B1 * | 10/2002 | Pountney | 40/607.13 |
| 6,539,754 | B1 * | 4/2003 | Fang | 70/52 |
| 7,185,923 | B2 * | 3/2007 | McNeil et al. | 285/322 |
| 7,240,526 | B2 * | 7/2007 | Lee | 70/358 |
| 7,581,423 | B2 * | 9/2009 | Brojanac et al. | 70/455 |
| 7,661,280 | B1 * | 2/2010 | Weyland | 70/233 |
| 7,699,570 | B2 * | 4/2010 | Trotter et al. | 411/533 |
| 7,828,342 | B2 * | 11/2010 | Terry et al. | 292/327 |
| 7,958,758 | B2 * | 6/2011 | Trempala et al. | 70/283.1 |
| 8,146,953 | B2 * | 4/2012 | Nakata et al. | 285/249 |
| 8,186,921 | B2 * | 5/2012 | Lowman | 411/371.1 |
| 8,210,785 | B1 * | 7/2012 | Gager | 411/429 |
| 8,215,886 | B2 * | 7/2012 | Campbell et al. | 411/401 |
| 8,343,137 | B2 * | 1/2013 | Calimeri et al. | 604/534 |
| 8,397,764 | B2 * | 3/2013 | Palmer | 138/89 |
| 8,978,426 | B2 * | 3/2015 | Wang | 70/34 |
| 2003/0188558 | A1 * | 10/2003 | Shiao et al. | 70/369 |
| 2004/0055342 | A1 * | 3/2004 | Chen | 70/56 |
| 2004/0194516 | A1 * | 10/2004 | Chen | E05B 21/066 70/54 |
| 2005/0166648 | A1 * | 8/2005 | Ruan | 70/134 |
| 2006/0185404 | A1 * | 8/2006 | Hansen | 70/38 A |
| 2006/0266090 | A1 | 11/2006 | Brojanac et al. | |
| 2007/0071575 | A1 * | 3/2007 | Rudduck et al. | 411/386 |
| 2007/0102392 | A1 * | 5/2007 | Hoepner et al. | 215/237 |
| 2011/0094273 | A1 * | 4/2011 | Uliano | 70/53 |
| 2013/0068767 | A1 * | 3/2013 | Fraser et al. | 220/259.3 |
| 2013/0243545 | A1 * | 9/2013 | Oh | 411/321 |
| 2014/0263324 | A1 * | 9/2014 | Latham et al. | 220/259.1 |
| 2014/0321945 | A1 * | 10/2014 | Black | 411/383 |
| 2014/0346173 | A1 * | 11/2014 | Ledemeney | 220/258.2 |
| 2015/0096988 | A1 * | 4/2015 | Weyrauch | 220/284 |

FOREIGN PATENT DOCUMENTS

| | | | |
|---|---|---|---|
| CN | 201218001 | Y | 4/2009 |
| CN | 101523005 | A | 9/2009 |
| DE | 202007011135 | U1 | 10/2007 |
| DE | 20 2008 003590 | U1 | 6/2008 |
| DE | 102010014145 | B3 | 5/2011 |
| EP | 0 611 027 | A2 | 8/1994 |
| EP | 1 643 058 | A1 | 4/2006 |
| FI | 658 | U | 4/1993 |
| WO | WO 87/07669 | A1 | 12/1987 |
| WO | WO 2006/119222 | A2 | 11/2006 |

* cited by examiner

PADLOCK

FIELD OF THE INVENTION

This invention relates to padlocks.

PRIOR ART

A padlock consists of a body and a shackle. The shackle is generally shaped like the letter U. When a padlock is locked, both ends of the shackle are locked into the body. When the locking is opened, the shackle can be moved away from the body such that one end of the shackle separates from its connection to the body. In addition, in many padlock models, the shackle can be turned such that the end of the shackle separated from the body is not at the site of the shackle hole. The other end of the shackle remains attached in the body of the padlock.

In the body of the padlock is placed a lock cylinder, which is in connection with the shackle via a latch organ. The lock cylinder can be locked and opened using a suitable key, i.e. the lock cylinder can be turned into the locking position and into the opened position. In the locking position, the latch organ locks the end/ends of the shackle into the body of the padlock. In the opened position, the latch organ allows moving of the shackle in the manner described above. Latch organs are at least one, but usually there are two. In some special padlocks, there can be even several latch organs. The latch organ is usually a ball.

A padlock can be used in very different conditions. Conditions can be, for example, dusty, muddy, watery or all of the above. In addition, freezing can be present. In order that the padlock remain in working condition in the kind of demanding conditions described above, it is known to use gaskets in connection with the shackle holes of the body to prevent the entrance of dust, water and other dirt into the shackle drillings (drillings, which are made for the ends of the shackle) and through these into the lock cylinder. In addition, it is known to use a plastic flap to prevent the entrance of dust and other dirt into the key channel of the lock cylinder. The key channel is a hole in the lock cylinder, into which the key is pushed. The key channel is visible usually on the bottom surface of the padlock. As described in more detail, the lock cylinder is positioned in the padlock using a separate cover part, which has a keyhole. The cover part keeps the lock cylinder in its place and functions as the part protecting the lock cylinder when looking at the padlock from the direction of its bottom surface. The keyhole of the cover part is at the site of the key channel of the lock cylinder, and thus the key can be pushed into the lock cylinder through the keyhole of the cover part.

Although using gaskets and a plastic flap provides already a quite good level of protection against external conditions, nonetheless there is need for improvement in the level of protection, especially when conditions are especially difficult, such as, for example, deserts, gas stations, mines, the locking of truck containers etc.

BRIEF DESCRIPTION OF THE INVENTION

The object of the invention is to provide a padlock, which remains in working condition even in very dusty, watery or otherwise difficult conditions. In addition, there would be reason for forming the protection level of the lock to be selectable as well as updatable to an even a better level of protection. The protective structures should further be such that the ease of use of the padlock is as effortless as possible. The objects are achieved in the manner described in the claims.

A padlock 1 according to the invention comprises a shackle 3 and a body 2. The body comprises drillings 5, 5A for both ends 4, 4A of the shackle, a cylinder drilling 8, into which is placed a lock cylinder 10, and latch drillings 7 between the drillings 5, 5A and the cylinder drilling 8. Into the latch drillings 7 are placed latch organs 14, 22. The padlock further comprises gasket rings 9, which are arranged in connection with the drillings 5, 5A in the vicinity of the shackle holes 2A, 2B. The padlock 1 further comprises a threaded cover 16 with an external thread 16A for positioning the lock cylinder into the body 2. The threaded cover 16 comprises a keyhole 16B and recess 32 with an internal thread 33 around the key channel 16B on the outer surface 16C side of the threaded cover 16. The padlock comprises also a cap 17, which comprises a twisting part 27 and a cylinder projection 28 with an external thread 29, 29A. The external thread 29, 29A of the cap is arranged to be inserted into the internal thread 33 of the threaded cover. The cap 17 further comprises a gasket ring 30 on the cylinder projection side surface 30A of the twisting part 17.

The cap and the threaded cover as described above can optionally be installed in a padlock, when a better level of protection is desired than that provided by gasket rings 9 placed in connection with the drillings. The level of protection can be improved still beyond this, when the latch organs 14 are replaced by new latch organs, comprising a gasket.

LIST OF FIGURES

Figure 2:
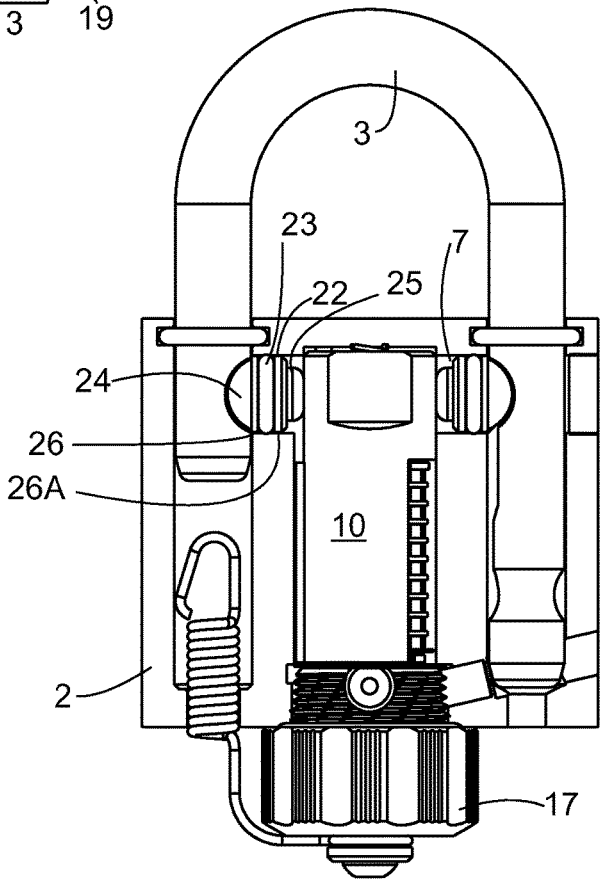
Figure 3:
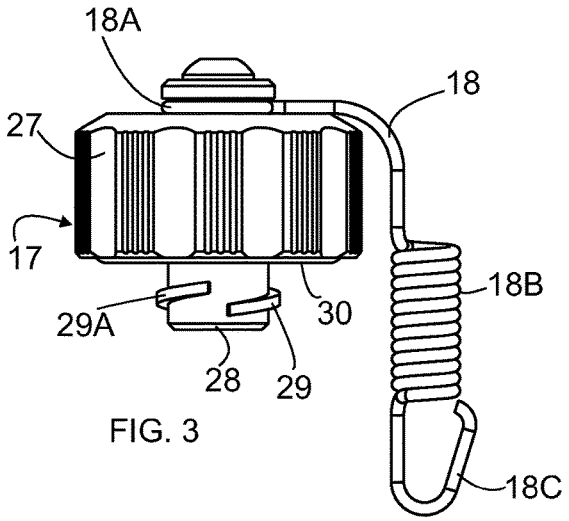
Figure 4:
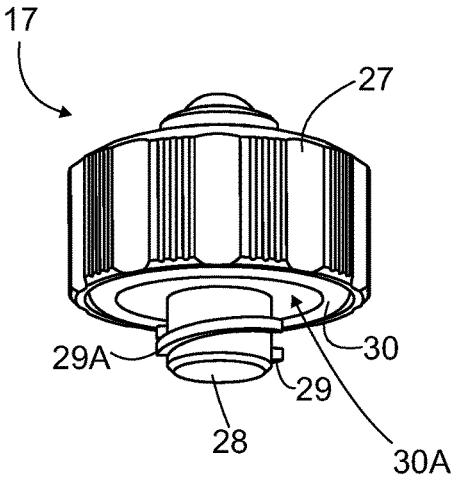
Figure 6:
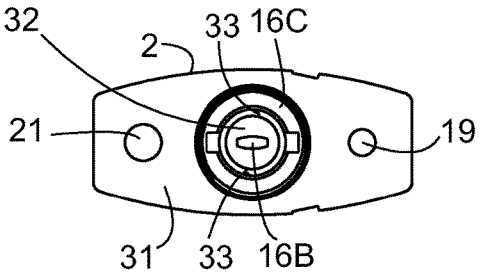
Figure 5:
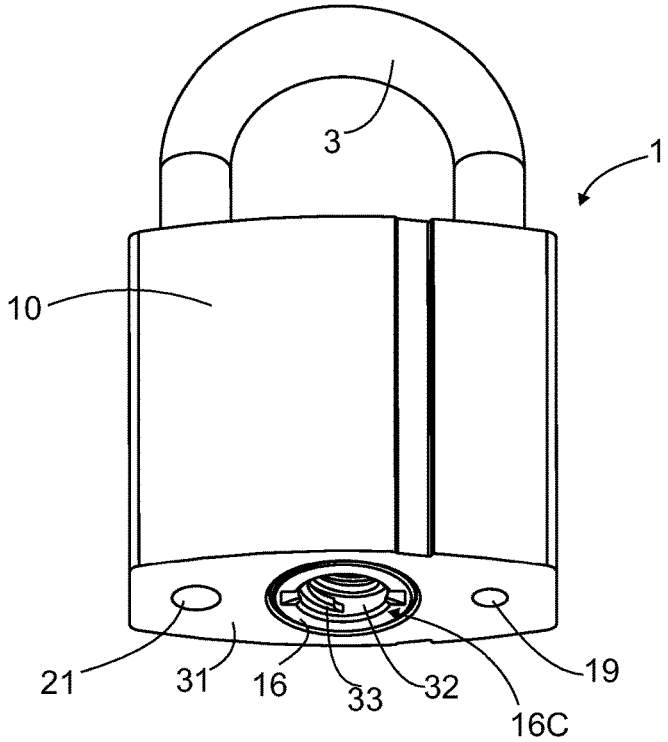
Figure 7A:
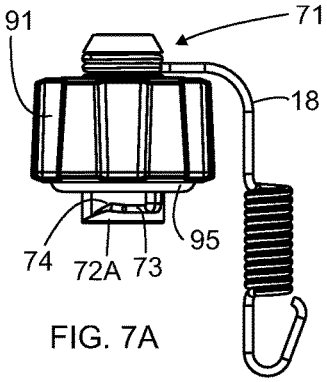
Figure 7B:
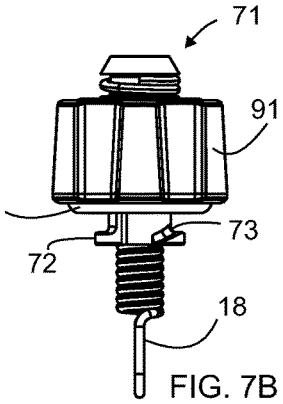
Figure 7C:
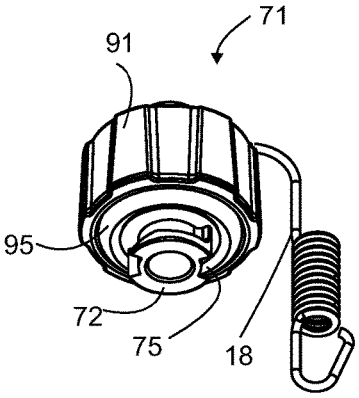
Figure 8A:
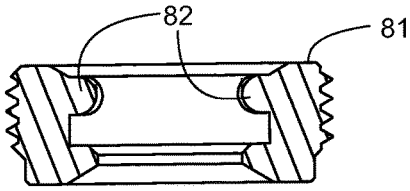
Figure 8B:
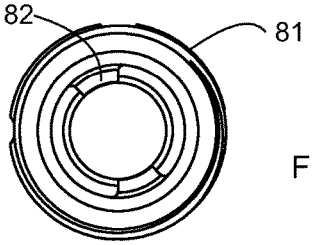

In the following, the invention is described in more detail by means of the figures of the accompanying drawings, in which drawings FIG. 1 shows an example of a padlock according to the invention, FIG. 2 shows another example of a padlock according to the invention, FIG. 3 shows an example of a part of the invention, FIG. 4 shows the example of FIG. 3 from another angle, FIG. 5 shows a feature of a padlock according to the invention, FIG. 6 shows the padlock as viewed from the direction of its bottom, FIGS. 7A-7C show one embodiment of the cap of the padlock, FIGS. 8A-8B show a threaded cover example for the cap of FIGS. 7A-7C, FIG. 9 shows a part of the cap of FIGS. 7A-7C, and FIG. 10 shows an exploded view of the cap of FIGS. 7A-7C.

DESCRIPTION

FIG. 1 shows an example of a padlock according to the invention. The ends 4, 4A of the shackle 3 are placed into the shackle drillings 5, 5A in the body 2. In the vicinity of the shackle holes 2A, 2B of the shackle drillings are arranged gasket rings 9 to prevent the entrance of dust, water and other dirt into the inner parts of the body 2.

The padlock 1 is generally quite rinse to the position shown in FIG. 1, when it is placed into the object to be locked, i.e. the gasket rings 9 in the vicinity of the shackle holes 2A, 2B protect mostly from dirt and water coming from above. From FIG. 1, it is also seen that the body has a drilling 8 (cylinder drilling) for the lock cylinder 10. The lock cylinder has cuts 12 for opening the locking. When the lock cylinder is turned using a suitable key, the cuts 12 turn against the latch organs 14, wherein they are free to move into the cuts 12, when the shackle 3 is pulled away from the body 2. The locking is thus open. In this example, the latch organs 14 are balls, which are placed into the latch drillings 7. The latch drillings are between the shackle drillings 5, 5A and the cylinder drilling 8. As can be observed from FIG. 1, the shackle comprises cavities 6 for the latch organs 14. Further, the shackle has a groove 11, in which the latch organ 14 is partially located, when the shackle 3 is pulled outward from the body 2. This groove 11 also locks the other end 4A of the shackle into the body 2, i.e. the shackle cannot be pulled completely away from its connection with the body 2.

The object to be locked can be such that the body 2 of the padlock is at least partially upwards or conditions are otherwise demanding, wherein there is need to protect also the keyhole 16B of the padlock from outside conditions. As was already stated earlier, for this purpose plastic flaps are used. In many cases, plastic flaps do not, however, offer a good enough level of protection in demanding applications. A solution according to the invention is to use a protective cap 17 to protect the keyhole 16B (and, at the same time, the key channel of the lock cylinder 10). The keyhole is in the threaded cover 16, using which the lock cylinder 10 is positioned into the cylinder drilling 8 of the padlock. The threaded cover has at least one cavity 15 for the attachment screw 13 of the threaded cover. The attachment screw is located in an attachment screw drilling 20, and locks the threaded cap 16 onto the body 2 of the padlock.

FIGS. 3 and 4 show in more detail the cap 17. FIG. 5 shows the padlock 1 diagonally from the direction of the bottom 31 of the padlock. In FIG. 5 is seen the threaded cover 16, which has a recess 32 around/at the site of the keyhole on the bottom 31 side. On the edges of the recess is an internal thread 33 for the external thread 29, 29A in the cap. The cap 17 comprises a twisting part 27 and a cylinder projection 28. The cylinder projection comprises said external thread. The cylinder projection 28 side surface 30A of the twisting part 27 comprises a gasket ring 30. The gasket ring settles against the bottom 31 of the padlock, when it is screwed down into the threaded cover 32. In this case, the external thread of the cylinder projection settles in the internal threads 33 of the threaded cover 16. The cap and its gasket ring efficiently prevent the entrance of water and dirt through the keyhole 16B into the lock cylinder.

Because the gasket ring 30 of the cap can be pressed against the bottom 31 of the padlock even very tightly, unscrewing it can be difficult. In addition, the object to be locked can be such that the padlock 1 is in such a position that opening/locking it with a key is otherwise difficult. To facilitate the use of the cap, the thread can be stiff, and, further, it can be a double thread. The pitch of the thread is, for example, 3-5 mm. Or then, the pitch of the thread can be even more on one rotation. A double-threaded structure is such that two threads are overlapping in relation to each other. The starting ends of the threads are 180 degrees apart from each other as examined from the axis of the cylinder projection. Thus, when the cap is screwed down against the threaded cover 16, then the threads 29, 29A, 33 always strike the correct site, when the cap is turned at the most 180 degrees. When using a normal thread, it may be necessary to turn the cap as much as 360 degrees, before the threads strike the correct site. In a difficult object to be locked, this can be a significant disadvantage. For the sake of clarity, let it be mentioned that, when using a normal thread, the corresponding threads of the cap 17 and of the threaded cover 16 are both normal threaded. Correspondingly, when using a double thread, the corresponding threads of the cap 17 and of the threaded cover 16 are both double-threaded.

From the figures, it can be observed that the cap can be attached to the body 2 of the padlock with a special spring 18. The spring of the presented embodiment is a stiff metal wire, the other end 18A of which is attached in the cap 17. The other end 18C of the spring is bent into a flexible hook, which locks the spring into connection with the body 2, when it is pushed through the hole 21 in the bottom 31 into the second shackle drilling 5. The spring has also a coil spring portion 18B, which fits through said bottom hole 21 to be pushed at least partially into the shackle drilling. FIGS. 1 and 2 show such a situation, when the cap 17 is screwed down onto the padlock. When the cap is unscrewed, the spring portion 18B moves simultaneously outward from the shackle drilling. When the cap is completely unscrewed, then the spring portion can possibly still be pulled away from the lock body and the cap 17 can be turned away from the site of the keyhole 16B for pushing a key into the padlock 1. The coil spring portion allows also bending of the spring in a sideways direction on the coil spring portion, which can be necessary in some difficult objects to be locked. When the cap is screwed back down, the spring guides the cap into the threads, facilitating the attachment of the cap, especially in low-light conditions. The spring 18 assures that the cap is not lost, when the padlock is opened/locked. Further, the stiff metal wire structure is not as susceptible to breaking as a more flexible metal wire (for example, thin multi-threaded flexible metal wire/rope).

FIG. 2 shows another embodiment of the invention, comprising a threaded cover 16 and cap 17 as presented above, and further comprising gasketed latch organs 22. The latch organs 22 comprise a gasket ring 23, which is placed in a groove formed to the cylindrical portion of the latch organ. On both sides of the groove and gasket ring is a strip 26, 26A of the cylindrical portion. The shackle side end 24 of the latch organ is shaped such that it corresponds to the shape of the recess 6 made in the shackle. The shape of the convex end 24 functions quite well, but it can also be some other shape. The lock cylinder side end 25 of the latch organ can, according to the example of FIG. 2, be smaller in diameter than the diameter of the cylindrical portion, onto which the gasket ring is placed. In addition, it can be rounded. The lock cylinder side end 25 can further be shaped into many different shapes. The gasket ring 23 prevents the entrance of dirt and water into the cylinder drilling 8 and the lock cylinder 10, in case dirt and water have already entered into the shackle drilling/drillings 5, 5A.

The protection level of the padlock can be raised from the level provided by the gasket rings 9 and protective cap 17 still to an extremely high level of protection by replacing or pre-installing gasketed latch organs 22 into the padlock. The latch organs 14 of the example of FIG. 1 can thus be replaced by gasketed latch organs 22. Thus, water and dirt that has possibly come into the shackle drilling through the holes 31, 19, 20 of the padlock cannot enter through the shackle drillings all the way to the lock cylinder. In tests, it has further been observed that water and dirt cannot enter through the drilling of the attachment screw 13 of the threaded cover 16 all the way to the lock cylinder.

The cylindrical portion of the latch organ is an important feature, as otherwise the latch organ could turn noticeably in relation to the axis of the latch drilling, wherein the gasket ring 23 would no longer be against the wall of the latch drilling. In this case, the gasket ring would no longer prevent the entrance of dirt and water into the cylinder drilling 8. In addition, when fitting the gasket ring onto the latch organ, it must be taken into account that the gasket pressure forming against the wall 7A of the latch drilling is not too great, as otherwise it would harm the functioning of the latch organ. In addition, it is possible that the cylinder drilling and possibly also other drillings are lubricated using Vaseline to facilitate moving of the latch elements. In addition, it is possible that the gaskets of the latch elements are of a material having a low coefficient of friction, wherein a separate lubricant is not necessarily required.

FIGS. 7A, 7B and 7C show another example of a cap 71 for protecting a keyhole. This embodiment also has a projection 72A, which can be screwed down onto a threaded cover. The threaded cover 81 of this embodiment is shown in FIGS. 8A and 8B. The projection 72A has two wings 72 with an attachment surface 73. The attachment surface settles against the inner wing 82 in the threaded cover, when the cap is screwed down. The attachment surface has further a small projection 74, which assures that the cap better remains in the screwed down position. Between the wings 72 is a gap 75.

Figure 9:
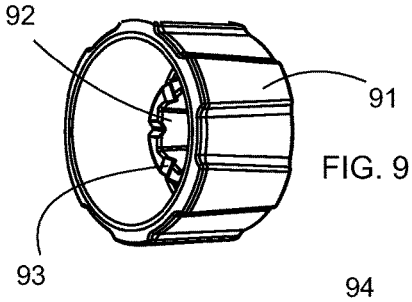
Figure 10:
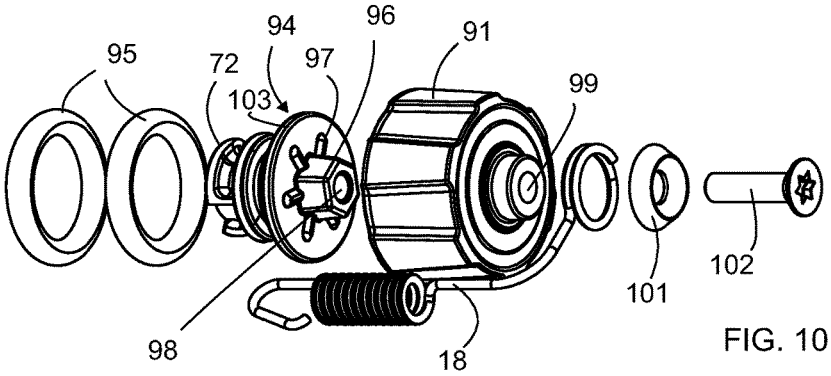

The cap of the embodiment of FIGS. 7A-7C is composed of several parts, as FIG. 10 shows. FIG. 9 shows the outer part 91 of the cap. An implementation comprising several parts is on the part of production an inexpensive manner, when the intension is to provide good protection characteristics and usability characteristics. The cap has two main parts, the outer part 91 and the inner part 94 to be attached thereto. Attachment of the parts to each other occurs using a screw 102. Both the outer part and the inner part have holes 99, 98 for screws. In order that the inner part and outer part would stay against each other well while in use, the outer part 91 has a hexagonal cone 92 and supplementary indentations 93, for which there are a corresponding hexagonal projection 96 and corresponding supplementary projections 97 in the inner part 94. The inner part comprises said projection 72A and the wings 72 in it. Said corresponding supplementary projections are in a flange-like structure 103 of the inner part. When two gasket rings 95 are used, good sealing characteristics and flexibility characteristics are achieved. The spring 18 is attached in the outer part. In addition, the cap comprises a ring 101, which can be used to assure the attachment of the spring.

The gasket rings presented above can be O-ring gaskets, but they can also be other types of gaskets, such as X-ring gaskets or square ring gaskets. As is obvious on the basis of what is described above, the invention can be implemented in many different ways, while staying within the scope of the independent claim.

The invention claimed is:

1. A padlock, comprising:
- a shackle;
- a lock body, the lock body comprising:
  - drillings for both ends of the shackle;
  - a cylinder drilling;
  - a lock cylinder placed in the cylinder drilling;
  - latch drillings between the drillings and the cylinder drilling;
  - latch organs placed in the latch drillings; and
  - a threaded cover with an external thread for positioning the lock cylinder into the body, the threaded cover being attached into the lock body by the external thread, the threaded cover comprising:
    - a key channel; and
    - a recess with inner wings around the key channel on an outer surface side of the threaded cover;
- gasket rings, which are disposed inside the lock body in the drillings in the vicinity of the shackle; and
- a cap, the cap comprising:
  - a twisting part;
  - a cylinder projection with outer wings, the outer wing being arranged to be inserted in the inner wing of the threaded cover; and
  - second gasket rings on the cylinder projection side part of the twisting part,
- wherein an entirety of the gasket rings are disposed inside the lock body in the drillings.

2. The padlock according to claim 1, wherein the cap comprises an outer part, an inner part and a spring, which are arranged to be attached to each other, and
- wherein the inner part has projections placed against recesses of the outer part.

3. A padlock, comprising:
- a shackle;
- a lock body, the lock body comprising:
  - drillings for both ends of the shackle;
  - a cylinder drilling;
  - a lock cylinder placed in the cylinder drilling;
  - latch drillings between the drillings and the cylinder drilling;
  - latch organs placed in the latch drillings; and
  - a threaded cover with an external thread for positioning the lock cylinder into the body, the threaded cover being attached into the lock body by the external thread, the threaded cover comprising:
    - a key channel; and
    - a recess with inner wings around the key channel on an outer surface side of the threaded cover;
- gasket rings, which are disposed inside the lock body in the drillings in the vicinity of the shackle; and
- a cap, the cap comprising:
  - a twisting part;
  - a cylinder projection with outer wings, the outer wing being arranged to be inserted in the inner wing of the threaded cover; and
- second gasket rings on the cylinder projection side part of the twisting part,
- wherein the threaded cover further comprises a cavity for receiving an attachment screw to lock the threaded cap into the lock body.

* * * * *